US005829900A

United States Patent [19]

Brown et al.

[11] Patent Number: 5,829,900

[45] Date of Patent: Nov. 3, 1998

[54] CONTAINER FOR COSMETIC STICK

[75] Inventors: Robert Nathan Brown, New York, N.Y.; Barbara Bone Poder, Brick, N.J.; Albert Joseph Stiso, Brick, N.J.; James J. Thalheimer, Toms River, N.J.; Robert John Wilczynski, Perth Amboy, N.J.; Monroe Adler Cochran, Ojai, Calif.

[73] Assignee: Revlon Consumer Products Corp., New York, N.Y.

[21] Appl. No.: 851,711

[22] Filed: May 6, 1997

[51] Int. Cl.[6] ..... A45D 40/06

[52] U.S. Cl. ..... 401/87; 401/68; 401/75; 401/86; 401/88

[58] Field of Search ..... 401/68, 75, 76, 401/86, 87, 88

[56] References Cited

U.S. PATENT DOCUMENTS

| | | | |
|---|---|---|---|
| 1,557,608 | 10/1925 | Perkins . | |
| 1,799,524 | 4/1931 | Morgan . | |
| 2,100,855 | 11/1937 | Kelley | 132/1 |
| 2,753,991 | 7/1956 | Sherman | 206/56 |
| 2,872,034 | 2/1959 | Harris | 206/56 |
| 2,964,770 | 12/1960 | Lerner | 15/136 |
| 3,082,869 | 3/1963 | Bau | 206/56 |
| 3,825,021 | 7/1974 | Seidler | 132/88.7 |
| 3,863,654 | 2/1975 | Morane | 132/88.7 |
| 4,369,158 | 1/1983 | Woodruff | 264/268 |
| 4,728,210 | 3/1988 | Barish | 401/6 |
| 4,813,801 | 3/1989 | Cardia | 401/71 |
| 4,890,944 | 1/1990 | Cousins | 401/98 |
| 5,346,323 | 9/1994 | Harris | 401/82 |

FOREIGN PATENT DOCUMENTS

| | | |
|---|---|---|
| 946797 | 6/1949 | France . |
| 4201064 | 1/1992 | Germany . |
| 314497 | 7/1956 | Switzerland . |
| 671388 | 5/1952 | United Kingdom . |
| 925270 | 5/1963 | United Kingdom . |
| 9619130 | 6/1996 | WIPO . |

*Primary Examiner*—Steven A. Bratlie
*Attorney, Agent, or Firm*—Julie Blackburn

[57] ABSTRACT

A dispenser for a cosmetic stick comprising (a) a removable cap in the form of a sleeve having an open upper end, for containing the cosmetic stick, (b) a base in the form of a sleeve having an open upper end, (c) fitted inside the base sleeve, an internal sleeve open at both ends for containing the cosmetic stick, (d) a product advancing mechanism comprising a platform which forms the bottom closure of the internal tubular sleeve, the platform having an upper surface having two protrusions affixed thereto, and a lower surface, and (e) a porous material affixed to the upper surface of the platform and securing the cosmetic stick to the platform.

20 Claims, 3 Drawing Sheets

CONTAINER FOR COSMETIC STICK

TECHNICAL FIELD

The invention is directed to a dispenser for dispensing cosmetic stick products such as lipstick, deodorant, makeup, treatment products, pharmaceutical treatments and the like. More particularly, this invention is directed to a mechanism for anchoring lipstick in a dispenser and for preventing stick breakage upon dispensing the lipstick from the dispenser.

BACKGROUND OF THE INVENTION

Stick breakage, in general, for example at the stick base, is a common problem with stick cosmetic products. In particular, lipsticks, particularly the new transfer resistant lipsticks, tend to be fragile due to the high content of volatile liquids, and are subject to stick breakage. Standard lipsticks are prepared by pouring a molten lipstick formula into a lipstick mold. A lipstick bullet is formed in the mold. The base of the lipstick bullet is then inserted into a cup, and the entire mechanism including the lipstick bullet and cup is inserted into a lipstick dispenser. However, certain lipsticks having fragile stick structures are "direct poured", which means that the molten lipstick is poured directly into a container within the lipstick dispenser. In particular, the molten lipstick is poured into a container such as an inner tubular sleeve which is fitted inside the base of a lipstick dispenser and serves as a support for the fragile stick, particularly while the dispenser is in the retracted position. A platform, which is capable of being raised and lowered by an advancing mechanism, forms the bottom closure of the inner sleeve. Typically, the platform is raised by rotating the base of the dispenser, such as with a screw-type mechanism, thus pushing the lipstick bullet out of the dispenser sleeve. Various types of anchoring mechanisms have been used in an attempt to better secure the lipstick bullet to the platform. One anchoring mechanism is known as a "mushroom", which is a small mushroom-shaped plastic piece which is molded onto the top surface of the platform. When the molten lipstick is poured into the inner tubular sleeve, the molten lipstick hardens around the mushroom, which secures the stick. However, while mushrooms do anchor the stick and assist in preventing stick breakage, there still is a need for better mechanisms to anchor the stick and prevent stick breakage at the base.

An object of this invention is to provide an improved mechanism for anchoring lipstick in a dispenser and preventing stick breakage when dispensing the lipstick.

Another object of this invention is to provide an improved lipstick dispenser for dispensing lipsticks and, in particular, those prone to stick breakage.

SUMMARY OF THE INVENTION

This invention overcomes the drawbacks associated with conventional dispensers for cosmetic stick products, which have been discussed above.

In one aspect, this invention provides a container for a cosmetic stick comprising:

a) a removable cap in the form of a sleeve having an open lower end, b) a base in the form of a sleeve having an open upper end, c) fitted inside said base sleeve, an internal sleeve having an open upper end for containing said cosmetic stick, d) product advancing means comprising a platform which forms the bottom closure of said sleeve, said platform having an upper surface having affixed thereto two protrusions, and a lower surface, and e) a porous material affixed to the upper surface of the platform, for securing the cosmetic stick to the platform.

In a second aspect, the invention comprises a dispenser for a cosmetic stick comprising:

a) a base in the form of a sleeve having an open upper end, b) fitted inside said base sleeve, an internal sleeve having an open upper end for containing said cosmetic stick, c) product advancing means comprising a platform which forms the bottom closure of said internal sleeve, said platform having an upper surface having two protrusions affixed thereto, and a lower surface, and d) a porous material affixed to the upper surface of the platform, for securing the cosmetic stick to the platform.

Another aspect of the invention comprises a method of forming a cosmetic stick in a dispenser, said method comprising:

a) providing a base in the form of a sleeve having an open upper end, b) fitting inside the base sleeve, an internal sleeve having an open upper end for containing the cosmetic stick, c) providing product advancing means comprising a platform which forms the bottom closure of the internal sleeve, the platform having an upper surface with two protrusions affixed thereto, and a lower surface, d) affixing a porous material to the upper surface of the platform, e) pouring molten cosmetic material into the internal sleeve, f) causing the molten cosmetic material to permeate the porous material, and g) allowing the molten cosmetic material to solidify into the cosmetic stick, which is secured to the platform by the porous material.

DESCRIPTION OF THE PREFERRED EMBODIMENTS

Figure 4:
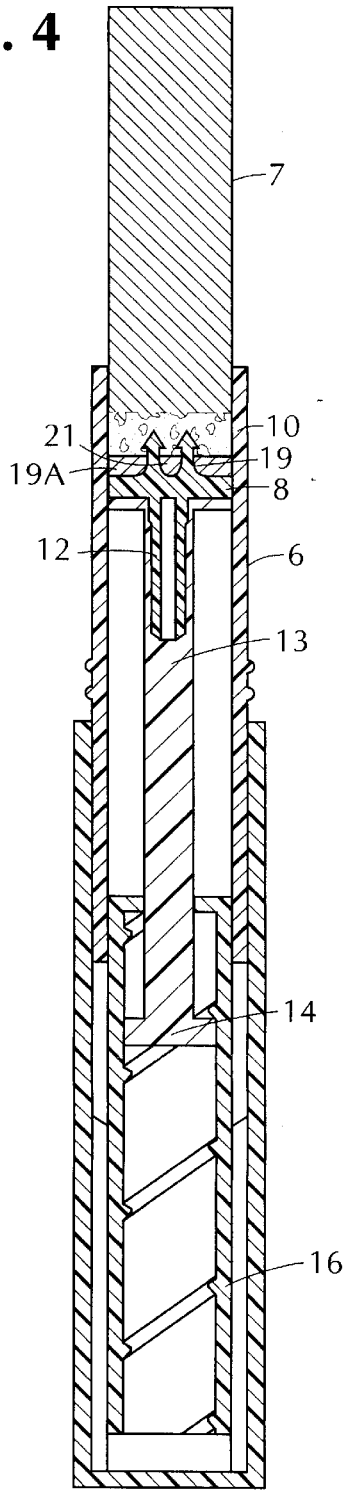
FIG. 4 illustrates a cross-sectional view of the lipstick dispenser of FIG. 2, taken along line 4—4.
Figure 6:
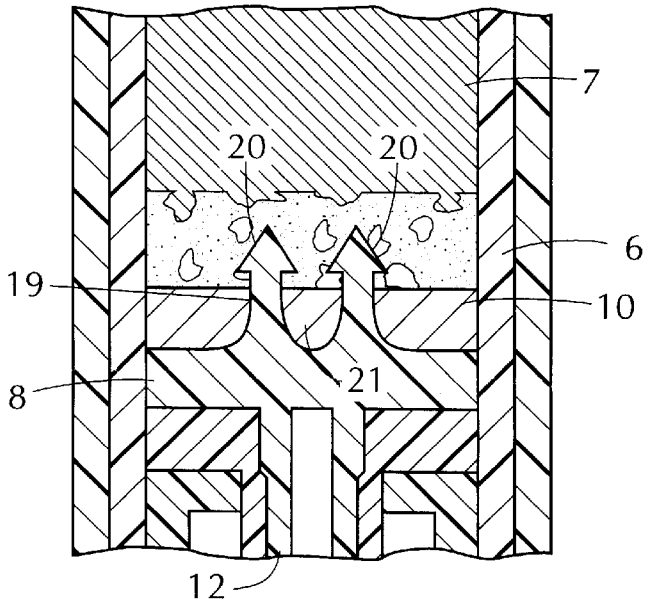
FIG. 6 shows the platform containing the porous material, which is utilized in the cosmetic stick dispenser of this invention.
Figure 7:
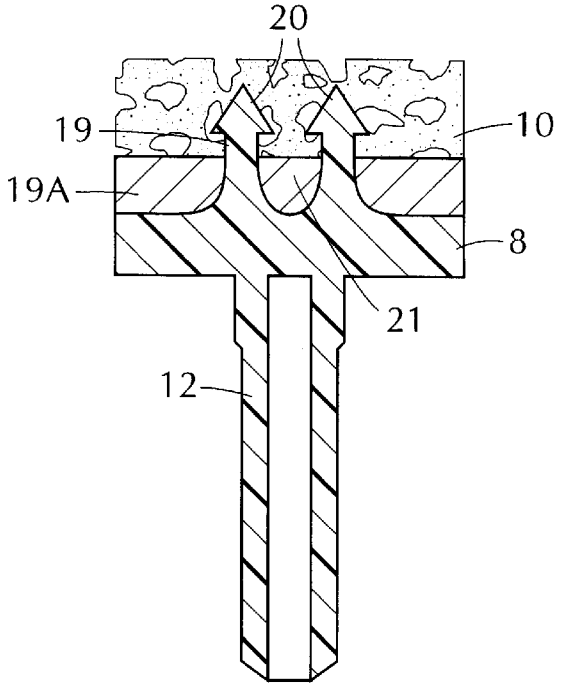
FIG. 7 shows the platform and a projection depending therefrom and two protrusions on the upper surface of the platform.

The cosmetic stick dispenser 1 of this invention comprises (i) a removable cap 2 in the form of a sleeve having an open lower end 3, and (ii) a base 4 in the form of a sleeve having an open upper end 5. Preferably the sleeves for the removable cap 2 and the base 4 are tubular in configuration. Fitted inside the sleeve of said base 4 is an internal sleeve 6 for holding the cosmetic stick material (product) 7. Forming the bottom closure of said internal sleeve 6 is a platform 8 having an upper surface and a lower surface. The upper surface of the platform 8 has two protrusions 19 which terminate in a head 20 which is larger in diameter than the diameter of the protrusion. Preferably, the head 20 is in the shape of an arrowhead and the compartment 21 which is formed between the protrusions 19 serves as a partial mechanical means for securing the porous material 10. The platform 8 has affixed to said lower surface a projection 12. The projection 12 is capable of fitting snugly into an elongated tube 13 which forms part of the product advancing mechanism 9. The projection 12 as fitted into the elongated tube 13 is illustrated in FIG. 4 wherein part of the elongated tube 13 is cut away.

The elongated tube 13 has a base member or driver 14. The base member or driver 14 forms the bottom closure of a tubular sleeve 16 having a helical track 17 along its inner surface. When the base 4 of the cosmetic stick dispenser is rotated, the driver 14 is forced up the helical track 17, and the stick product 7, which rests on the platform 8, is ejected from the dispenser.

Figure 5:
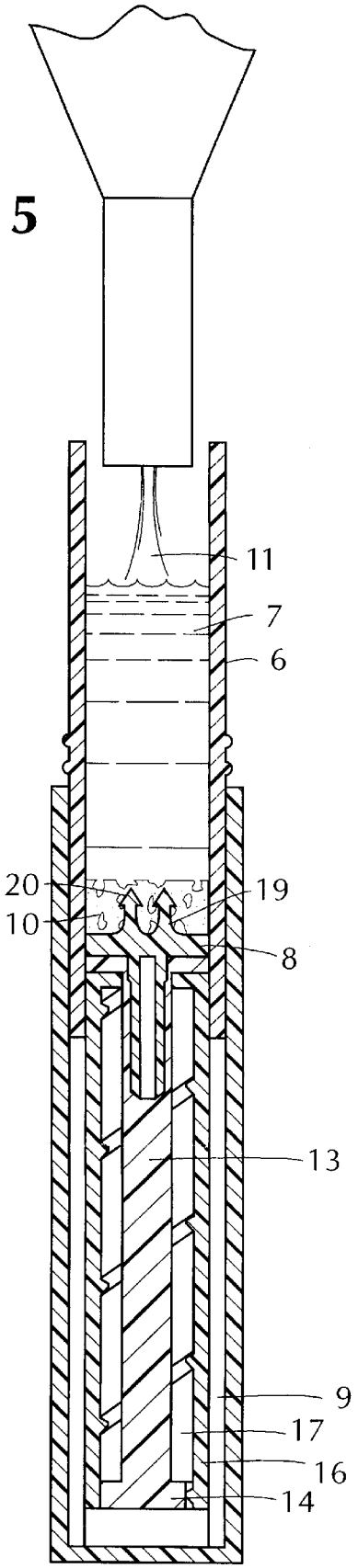
FIG. 5 shows a cross-sectional view of the lipstick dispenser shown in FIG. 1, for example, and illustrates how the dispenser is direct filled.
Figure 3:
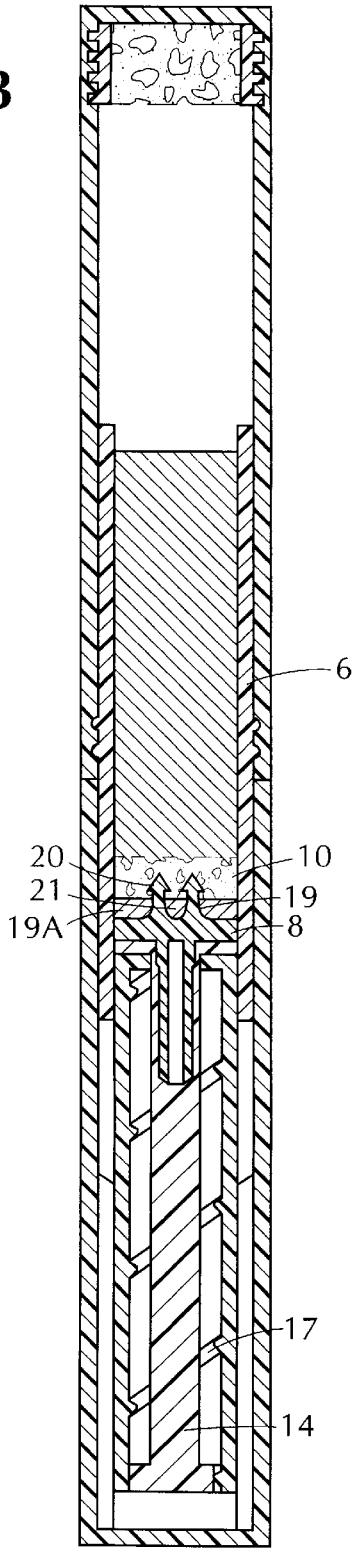
FIG. 3 illustrates a cross-sectional view of the lipstick dispenser of FIG. 1, taken along line 3—3.

Affixed to the top of the platform 8 is a porous material 10 which is pierced by the protrusions 19. Preferably the porous material 10 is an open-celled porous material such as foam. Any type of porous material is suitable provided it contains cells. As mentioned it is preferred that the cells in the porous material are open-celled, i.e., have interconnected channels which will permit the molten material of the cosmetic stick to permeate into the porous material and set therein, when the material is poured or injected into or otherwise fills the dispenser. In the preferred embodiment of the invention the porous material 10 is in the form of a laminate of several layers 19A of similar or dissimilar porous material. It should also be noted that while in the preferred embodiment of the invention the porous material is affixed to the upper surface of the platform, it is possible that the porous material could be molded with the platform so that the porous material and platform are one piece. The porous material is secured to the platform 8 by mechanical means, i.e. due to the structure of the platform and the protrusions which act to secure the porous material 10 when it is fitted onto the platform and pierced by the protrusions 19. Generally, foams made of synthetic polymeric materials such as polystyrene, polyethylene, polypropylene, polyurethane, and the like are preferred. When the dispenser 1 is filled, as illustrated in FIG. 5, the molten cosmetic material 11 is poured, for example, into the inner sleeve 6. The molten cosmetic material 11 permeates the porous material 10. When the molten cosmetic material 11 cools to room temperature, the molten cosmetic material 11 has adsorbed and absorbed into the porous material 10, which serves as an anchor for the cosmetic stick 7. In particular, the molten cosmetic material flows into the channels and interstices of the foam and also remains adsorbed onto the surfaces of the foam.

Figure 1:
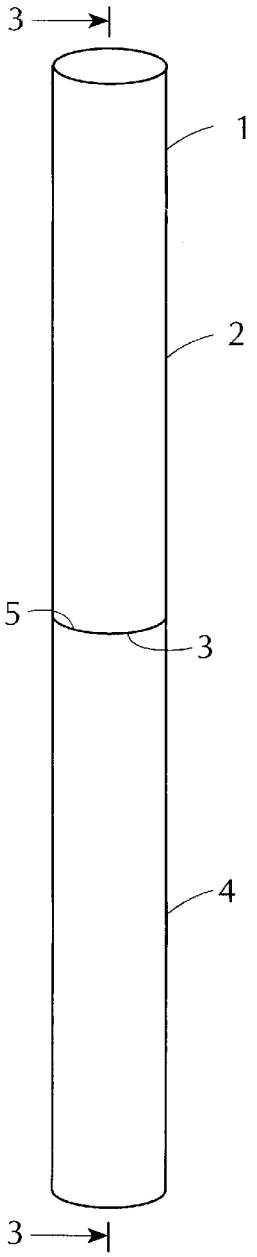
FIG. 1 illustrates the cosmetic stick dispenser of this invention, in the closed position.
Figure 2:
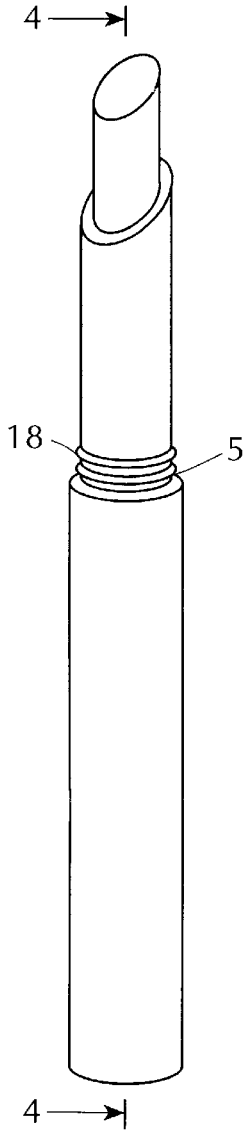
FIG. 2 illustrates the cosmetic stick dispenser of this invention, with the cap removed.

It is preferred that the stick dispensers 1 of this invention be hermetically sealed. This may be accomplished by making a series of ribs 18, as illustrated in FIG. 2, on the outer surface of said inner tubular sleeve 6. These ribs 18 are capable of engaging with similarly shaped projections found on the inner surface of said removable cap 2 (not shown). When the removable cap 2 is affixed to said base 4, the projections (not shown) engage with the ribs 18 and cause the cap 2 to become hermetically sealed, when it is affixed to the base 4.

The invention prevents stick breakage because the molten lipstick hardens within the channels and on the surface of the porous material. The resulting lipstick base then becomes reinforced with the porous material, which also acts as a shock absorber and stick anchor, thereby reducing stick breakage.

While the invention has been described in connection with the preferred embodiment, it is not intended to limit the scope of the invention to the particular form set forth but, on the contrary, it is intended to cover such alternatives, modifications, and equivalents as may be included within the spirit and scope of the invention as defined by the appended claims.

We claim:

1. A dispenser for a cosmetic stick comprising:

a) a removable cap in the form of a sleeve having an open lower end, b) a base in the form of a sleeve having an open upper end, c) fitted inside said base sleeve, an internal sleeve having an open upper end for containing said cosmetic stick, d) product advancing means comprising a platform which forms the bottom closure of said internal sleeve, said platform having an upper surface having two protrusions affixed thereto, and a lower surface, and e) a porous material affixed to the upper surface of the platform, and securing the cosmetic stick to the platform.

2. The dispenser of claim 1 wherein the porous material is and open-celled foam.

3. The dispenser of claim 2 wherein the open-celled foam is made of a synthetic polymeric material.

4. The dispenser of claim 1 wherein the removable cap is in the form of a tubular sleeve.

5. The dispenser of claim 1 wherein the base is in the form of a tubular sleeve.

6. The dispenser of claim 1 wherein the internal sleeve is in the from of tubular sleeve.

7. The dispenser of claim 1 which is hermetically sealed.

8. The dispenser of claim 1 wherein the product advancing means further comprises an elongated tube having a driver.

9. The dispenser of claim 8 wherein the driver forms the closure of a tubular sleeve having a helical track on its inner surface.

10. The dispenser of claim 9 wherein when the base is rotated, the driver is forced up the helical track causing the cosmetic stick to be ejected from the dispenser.

11. The dispenser of claim 3 wherein the synthetic material is selected from the group consisting of polystyrene, polyurethane, polyethylene, and polypropylene.

12. The dispenser of claim 1 wherein a portion of the cosmetic stick is both adsorbed onto and absorbed into porous material.

13. The dispenser of claim 1 wherein the two protrusions have a head.

14. The dispenser of claim 13 wherein the head of the protrusions is larger in diameter than the protrusions.

15. A dispenser for a cosmetic stick comprising:

a) a base in the form of a sleeve having an open upper end, b) fitted inside said base sleeve, an internal sleeve having an open upper end for containing said cosmetic stick, c) product advancing means comprising a platform which forms the bottom closure of said internal sleeve, said platform having an upper surface having two protrusions affixed thereto, and a lower surface, and d) an open-celled porous material affixed to the upper surface of the platform for securing the cosmetic stick to the platform.

16. The dispenser of claim 15 wherein the base is in the form of a tubular sleeve.

17. The dispenser of claim 15 wherein the open-celled porous material is foam.

18. The dispenser of claim 15 wherein the product advancing means further comprises an elongated tube having a driver.

19. The dispenser of claim 18 wherein the driver forms the closure of a tubular sleeve having a helical track on its inner surface.

20. A method of forming a cosmetic stick in a dispenser, said method comprising:

a) providing a base in the form of a sleeve having an open upper end, b) fitting inside the base sleeve, an internal sleeve having an open upper end for containing the cosmetic stick, c) providing product advancing means comprising a platform which forms the bottom closure of the internal sleeve, the platform having an upper surface having two protrusions affixed thereto, and a lower surface, d) affixing an open-celled porous material to the upper surface of the platform, e) pouring molten cosmetic material into the internal sleeve, f) causing the molten cosmetic material to permeate the open-celled porous material, and g) allowing the molten cosmetic material to solidify into the cosmetic stick, which is secured to the platform by the open-celled porous material.

* * * * *